US008036820B2

(12) United States Patent
Sera

(10) Patent No.: US 8,036,820 B2
(45) Date of Patent: Oct. 11, 2011

(54) VEHICLE-MOUNTED DEVICE, TRAFFIC-INFORMATION ACQUISITION METHOD, TRAFFIC-INFORMATION PROVISION SYSTEM, AND TRAFFIC-INFORMATION PROVISION METHOD

(75) Inventor: Manabu Sera, Chigasaki (JP)

(73) Assignee: Nissan Motor Co., Ltd., Yokohama-shi, Kanagawa ( * ) Notice: Subject to any disclaimer, the term of this patent is extended or adjusted under 35 U.S.C. 154(b) by 42 days.

(21) Appl. No.: 11/764,840

(22) Filed: Jun. 19, 2007

(65) Prior Publication Data

US 2008/0004791 A1 Jan. 3, 2008

(30) Foreign Application Priority Data

Jun. 30, 2006 (JP) ..... 2006-182277

(51) Int. Cl.
*G06G 7/76* (2006.01)
*G08G 1/00* (2006.01)

(52) U.S. Cl. ..... 701/117; 701/118; 701/119; 701/201; 701/202; 701/206; 701/209; 701/210

(58) Field of Classification Search ..... 701/117, 701/118, 119, 201, 202, 206, 209, 210; 370/237, 370/238; 340/905, 917, 991, 993, 994, 995.13, 340/995.21, 995.19
See application file for complete search history.

(56) References Cited

U.S. PATENT DOCUMENTS 6,618,667 B1 * 9/2003 Berwanger et al. ..... 701/117
6,741,927 B2 * 5/2004 Jones ..... 701/201
6,822,940 B1 * 11/2004 Zavalkovsky et al. ..... 370/237
6,950,745 B2 * 9/2005 Agnew et al. ..... 701/210
7,386,391 B2 * 6/2008 Morariu et al. ..... 701/117
7,477,989 B2 * 1/2009 Tomoda ..... 701/209
7,493,214 B2 * 2/2009 Jung et al. ..... 701/209
2003/0187573 A1 * 10/2003 Agnew et al. ..... 701/201
2003/0227392 A1 * 12/2003 Ebert et al. ..... 340/825.49
2004/0158393 A1 * 8/2004 Oonishi et al. ..... 701/201
2004/0202111 A1 * 10/2004 Beshai et al. ..... 370/237
2005/0125148 A1 * 6/2005 Van Buer et al. ..... 701/209
2005/0201376 A1 * 9/2005 Iizuka et al. ..... 370/392
2005/0209772 A1 * 9/2005 Yoshikawa et al. ..... 701/200
2005/0256639 A1 * 11/2005 Aleksic et al. ..... 701/210
2006/0031007 A1 * 2/2006 Agnew et al. ..... 701/204
2006/0064241 A1 * 3/2006 Rasmussen et al. ..... 701/201
2006/0069501 A1 * 3/2006 Jung et al. ..... 701/209
2006/0100778 A1 * 5/2006 Lee et al. ..... 701/210
2006/0161342 A1 * 7/2006 Tomoda ..... 701/209
2006/0206256 A1 * 9/2006 Kumagai et al. ..... 701/117
2006/0224302 A1 * 10/2006 Kwok et al. ..... 701/200
2006/0268736 A1 * 11/2006 Lee et al. ..... 370/252
2006/0268737 A1 * 11/2006 Lee et al. ..... 370/252
2007/0030175 A1 * 2/2007 Horstemeyer ..... 340/994
2007/0118273 A1 * 5/2007 Tang et al. ..... 701/117
2007/0168131 A1 * 7/2007 Root et al. ..... 702/3
2007/0208498 A1 * 9/2007 Barker et al. ..... 701/117
2008/0046165 A1 * 2/2008 Downs et al. ..... 701/117

FOREIGN PATENT DOCUMENTS

JP 2003-030780 1/2003
JP 2005-241519 9/2005

* cited by examiner

*Primary Examiner* — Khoi Tran
*Assistant Examiner* — Jorge Peche
(74) *Attorney, Agent, or Firm* — Young Basile

(57) ABSTRACT

When a change occurs between a previous traffic condition based on traffic information provided previously and the current traffic condition, a control unit of a vehicle-mounted device performs control such that traffic information is acquired from an external device via wireless communication. A comparison of current vehicle traveling conditions and previous vehicle traveling conditions can also be used to determine whether traffic information should be updated.

20 Claims, 5 Drawing Sheets

CONGESTED
CROWDED
SMOOTH

VEHICLE-MOUNTED DEVICE, TRAFFIC-INFORMATION ACQUISITION METHOD, TRAFFIC-INFORMATION PROVISION SYSTEM, AND TRAFFIC-INFORMATION PROVISION METHOD

CROSS-REFERENCE TO RELATED APPLICATION

This application claims priority from Japanese Patent Application Serial No. 2006-182277, filed Jun. 30, 2006, which is incorporated herein in its entirety by reference.

TECHNICAL FIELD

The invention relates in general to a vehicle-mounted device that acquires and provides traffic information in accordance with traffic conditions and vehicle traveling conditions that change in real time.

BACKGROUND

A communications navigation system that acquires traffic information provided from a traffic information center via wireless communication and that provides route guidance in accordance with the acquired traffic information has been suggested. One example of such a system is shown in Japanese Unexamined Patent Application Publication No. 2003-30780). Such a communications navigation system automatically acquires traffic information from the traffic information center, searches for a route in an initial stage of navigation processing for setting a destination and suggests a route that satisfies a user's request by appropriately acquiring the latest traffic information and recalculating a route to the destination during the provision of navigation. Accordingly, such a communications navigation system is capable of providing excellent traveling support.

When traffic information is acquired from the traffic information center, a portable telephone line is used. Thus, a user has to pay a communication fee, such as a line connection fee, and an information use fee.

SUMMARY

Embodiments of a vehicle-mounted device that acquires and provides traffic information in accordance with traffic conditions and vehicle traveling conditions that change in real time, a traffic-information acquisition method, a traffic-information provision system and a traffic-information provision method are taught herein. One example of a vehicle-mounted device that acquires traffic information for a vehicle comprises a traffic-information acquisition unit configured to acquire the traffic information from an external device via wireless communication and a controller configured to control the traffic-information acquisition unit to acquire current traffic information from the external device when a change occurs between a current traffic condition and a previous traffic condition based on previously-provided traffic information. Other embodiments of the invention are also taught herein.

BRIEF DESCRIPTION OF THE DRAWINGS

The description herein makes reference to the accompanying drawings wherein like reference numerals refer to like parts throughout the several views, and wherein.

DETAILED DESCRIPTION OF EMBODIMENTS OF THE INVENTION

The communications navigation system described in Japanese Unexamined Patent Application Publication No. 2003-30780 is configured to acquire traffic information at predetermined time intervals in the case that traffic information is acquired using a portable telephone line. Thus, even when no change has occurred in a traffic condition and traffic information has thus not been updated, a request for acquiring traffic information is made. Therefore, a user has to pay a wasteful communication fee.

Accordingly, it is desirable to provide a vehicle-mounted device that is capable of reducing a communication fee by acquiring traffic information only when the amount of change between the previous traffic condition and the current traffic condition is larger than a predetermined threshold. Thus, in a vehicle-mounted device that is mounted in a vehicle and that acquires traffic information, when a change occurs between the previous traffic condition based on traffic information provided previously and the current traffic condition, the vehicle-mounted device acquires traffic information from an external device. Since the vehicle-mounted device acquires traffic information when a change occurs between the previous traffic condition and the current traffic condition, a communication fee can be satisfactorily reduced.

Certain embodiments of the invention are described with reference to the drawings. A traffic-information provision system according to a first embodiment of the invention is described with reference to FIG. 1.

Figure 1:
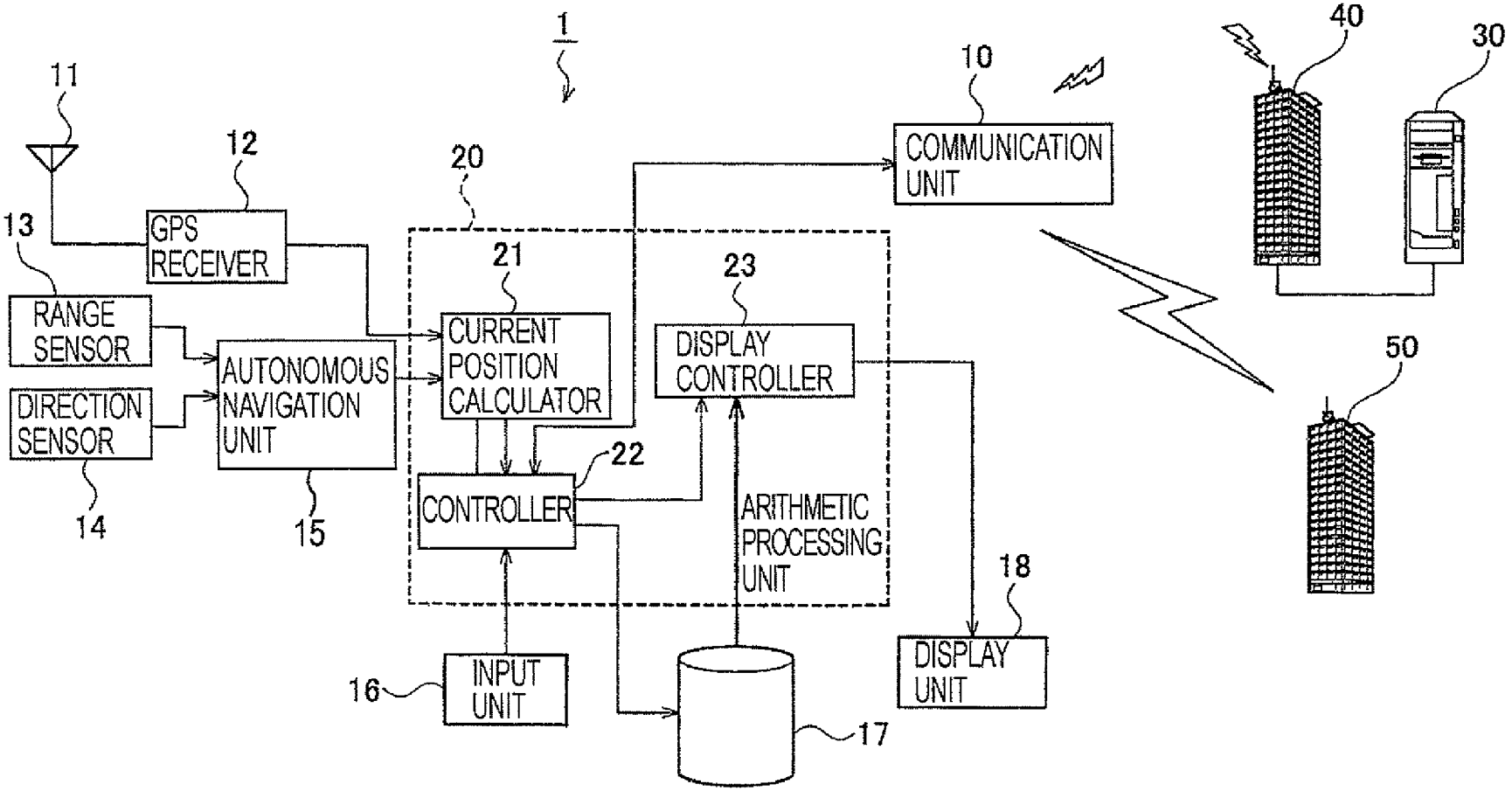
FIG. 1 shows a configuration of a traffic-information provision system according to a first embodiment of the invention.

Referring to FIG. 1, the traffic-information provision system includes a vehicle-mounted device 1, a device external to the vehicle such as a center device 30, a communication center apparatus 40 and a vehicle information center, shown by example as a Vehicle Information and Communication System (VICS) Center 50. The vehicle-mounted device 1 is mounted in a vehicle, which is a movable body. The vehicle-mounted device 1 is capable of providing route guidance to reach a destination set by a user. The center device 30 is a central processing unit that generally operates and administrates the traffic-information provision system. The center device 30 provides traffic information to the vehicle-mounted device 1.

Traffic information provided from the center device 30 is, for example, traffic information on roads that are not covered by traffic information provided (for example, available free of charge) from the VICS Center 50, which is a widely used system, (for example, the VICS Center 50 provides information on main roads, such as national roads and state roads, but does not provide information on minor streets, side roads, passages, and the like) or traffic information that complements traffic information provided from the VICS Center 50. The center device 30 generates traffic information to be provided to the vehicle-mounted device 1 using information collected by a certain procedure (for example, a probe survey, a questionnaire survey, or provision from the VICS Center 50) in accordance with an existing statistical procedure, forecasting calculation, or the like.

More specifically, in the probe survey, the center device 30 collects and accumulates probe data (for example, data on vehicle speed and vehicle position) from a plurality of vehicles. Then, for example, statistical data on traffic congestion time of each of a plurality of road sections is generated for every season, every day of the week, every time zone, and the like. Thus, a near-future prediction about whether traffic congestion will get better or get worse is available. In the questionnaire survey, for example, information indicating that traffic congestion can be avoided by choosing a certain road in a certain time zone is accumulated in the center device 30.

In addition, the center device 30 collects traffic information from the VICS Center 50 and predicts future traffic congestion. In accordance with traffic information provided from the VICS Center 50, the center device 30 is not capable of determining whether traffic congestion will get better or get worse or determining whether the traffic congestion occurs frequently or has occurred unexpectedly due to an accident or construction. This is because the traffic information provided from the VICS Center 50 is information on the current situation or information on a situation slightly previous to the current situation.

Although it is difficult to determine how long it usually takes to relieve traffic congestion, the use of the above-mentioned statistical procedure enables a near-future prediction about whether traffic congestion that frequently occurs will get better or get worse, Thus, high-accuracy information can be provided.

In the traffic-information provision system, the communication center apparatus 40 functions as a central communication processing apparatus that controls data communication between the vehicle-mounted device 1 and the center device 30. The communication center apparatus 40 performs communication control so that the vehicle-mounted device 1 and the center device 30 can perform data communication between each other via a relay device or the like. The data communication between the vehicle-mounted device 1 and the center device 30 is performed using a portable telephone line or the like, which has already been highly established as a communication infrastructure.

The center device 30 provides traffic information to the vehicle-mounted device 1 for a fee. Thus, the vehicle-mounted device 1 is charged for such fee. In addition, a line use fee for wireless communication with the center device 30 to acquire traffic information is charged to the vehicle-mounted device 1 in accordance with a communication time, the amount of transfer data, and the like.

The configuration of the vehicle-mounted device 1 is described next with reference to FIG. 1. Referring to FIG. 1, the vehicle-mounted device 1 includes a communication unit 10, a global positioning system (GPS) receiver 12 connected to a GPS antenna 11, a range sensor 13, a direction sensor 14, an autonomous navigation unit 15, an input unit 16, a storage unit 17, a display unit 18 and an arithmetic processing unit 20. The vehicle-mounted device 1 is mounted in a vehicle, which is a movable body. The vehicle-mounted device 1 provides route guidance to reach a desired destination while detecting the current position of the vehicle and displaying a map of map data corresponding to the current position of the vehicle.

The communication unit 10 is a communication interface that performs data communication with the center device 30 under the communication control of the communication center apparatus 40. The communication unit 10 may be a dedicated wireless communication unit provided in the vehicle-mounted device 1. Alternatively, for example, a portable terminal unit having a data communication function, such as a cellular phone, may be used as the communication unit 10. By way of this communication with the center device 30 the communication unit 10 acquires traffic information.

The communication unit 10 also has a reception function to receive traffic information provided from the VICS Center 50 via FM multiplex broadcasting, radio beacons or optical beacons. The reception function is a function only for receiving free traffic information provided from the VICS Center 50. Thus, the communication unit 10 does not request the VICS Center 50 to provide traffic information. By way of this communication with the VICS Center 50 the communication unit 10 also acquires traffic information.

The GPS receiver 12 performs positioning based on GPS navigation by receiving a signal transmitted from a GPS satellite via the GPS antenna 11 and acquires absolute position (that is, latitude and longitude) information. The GPS receiver 12 outputs the acquired absolute position information to the arithmetic processing unit 20.

The range sensor 13 detects a travel distance traveled by the vehicle. The range sensor 13 outputs the detected travel-distance information to the autonomous navigation unit 15.

The direction sensor 14 detects a traveling direction of the vehicle. The direction sensor 14 is, for example, a geomagnetic sensor, a wheel sensor, a gyroscope, or the like. The direction sensor 14 outputs the detected traveling-direction information to the autonomous navigation unit 15.

The autonomous navigation unit 15 acquires the relative position of the vehicle based on autonomous navigation in accordance with the travel-distance information output from the range sensor 13 and the traveling-direction information output from the direction sensor 14. The autonomous navigation unit 15 outputs the acquired relative position information to the arithmetic processing unit 20.

The input unit 16 is used by a user to input a command to the vehicle-mounted device 1, change settings of the vehicle-mounted device 1, input a desired destination for which route guidance is desired, select a desired route from among a plurality of suggested routes displayed on the display unit 18, and the like.

The input unit 16 is, for example, a keyboard, a touch panel used in combination with the display unit 18, a mouse, a pointing device, or the like. In addition, the input unit 16 may be a remote controller that performs remote control of the vehicle-mounted device 1.

The storage unit 17 stores various data necessary for navigation. For example, various software applications to be executed by the vehicle-mounted device 1, map data of a map to be displayed, road data used for map matching, route guidance, and the like, and icon data to be displayed on a map are stored in the storage unit 17. Although the storage unit 17 is shown separately from the arithmetic processing unit 20, the storage unit 17 could be incorporated therein.

In addition, a storage region is provided in the storage unit 17 in which traffic information provided from the center device 30 and the VICS Center 50 is stored. For example, an optical disk, which is a removable storage medium, or a hard disk (HD), which is fixedly installed, may be used as the storage unit 17. Alternatively, a removable medium including a semiconductor memory, such as a flash memory, may be used as the storage unit 17.

The arithmetic processing unit 20 includes a current position calculator 21, a controller 22 and a display controller 23. The arithmetic processing unit 20 can consist of a microcomputer including central processing unit (CPU), input and output ports (I/O) receiving certain data described herein, random access memory (RAM), keep alive memory (KAM), a common data bus and read only memory (ROM) as an electronic storage medium for executable programs and certain stored values as discussed herein. The functional (or processing) sections of the unit 20, such as the current position calculator 21, the controller 22 and the display controller 23 can be, for example, implemented in software as the executable programs, or could be implemented in whole or in part by separate hardware in the form of one or more integrated circuits (IC). Arithmetic processing unit 20 can also be a central processing unit with separately provided peripheral components. Also, although unit 20 is shown as a unitary device, each of the calculator 21, controller 22 and display controller 23 can be separate microprocessors/microcontrollers.

The current position calculator 21 calculates the current position of the vehicle on a map in accordance with the absolute position (latitude and longitude) information output from the GPS receiver 12 and the relative position information output from the autonomous navigation unit 15. The current position calculator 21 outputs the calculated current position information to the controller 22.

The controller 22 generally controls the vehicle-mounted device 1. The controller 22 instructs the display controller 23 to read from the storage unit 17 various data necessary for navigation, such as corresponding map data, road data, and the like, in accordance with the current position information output from the current position calculator 21.

In addition, the controller 22 executes a software application stored in the storage unit 17. In accordance with a destination entered via the input unit 16 and the current position information output from the current position calculator 21, the controller 22 searches for an optimal traveling route from the current position to the destination and provides route guidance (navigation) of the obtained optimal traveling route. The controller 22 is capable of providing route guidance corresponding to traffic conditions and vehicle traveling conditions by using traffic information acquired from the center device 30 and the VICS Center 50. Here, "traffic information" includes, for example, information on traffic accidents, road construction, road congestion state, road crowding state, a road smooth state, road regulations, weather, and the like, In addition, "traffic condition" represents, for example, a traffic state on a road (for example, the length of traffic congestion, such as some miles or kilometers of traffic congestion) based on information on a traffic accident or traffic congestion included in the traffic information.

The controller 22 may provide route guidance by displaying an obtained optimal route on a map via the display unit 18 or by outputting sound from a sound output unit (not shown) provided in the vehicle-mounted device 1.

When the vehicle is located within a reception range of FM multiplex broadcasting, radio beacons or optical beacons, the controller 22 stores traffic information provided from the VICS Center 50, which is automatically acquired via the communication unit 10. The controller 22 generally stores this information in a predetermined storage region of the storage unit 17 and uses the stored traffic information for route guidance.

In an initial stage for setting a destination for the first time and providing route guidance, the controller 22 controls the communication 10 to access the center device 30 and acquire traffic information from the center device 30. During the provision of the route guidance in which the destination has already been set, the controller 22 also accesses the center device 30 via the communication unit 10 in accordance with a result of a predetermined threshold-based determination discussed herein.

More specifically, during the provision of route guidance, the controller 22 calculates a comparison parameter indicating a temporal change in a traffic condition of a traveling road from the current position to the destination or a temporal change in a vehicle traveling condition. If the calculated comparison parameter is larger than a threshold, the controller 22 accesses the center device 30 via the communication unit 10 and acquires desired traffic information.

A comparison parameter, which is more fully described later, is a result of a comparison between the previous traffic condition of the route to the destination and the current traffic condition of the route to the destination. Alternately, or in addition thereto, the comparison parameter is a result of a comparison between the previous traveling condition of the vehicle traveling along the route to the destination and the current traveling condition of the vehicle traveling along the route to the destination. Thus, the controller 22 determines the degree of a comparison result by performing a threshold-based determination of the comparison parameter. That is, if the comparison parameter is larger than a threshold, the controller 22 determines that a large change has occurred between the previous traffic condition of the route to the destination and the current traffic condition of the route to the destination, or between the previous traveling condition of the vehicle traveling along the route to the destination and the current traveling condition of the vehicle traveling along the route to the destination. Thus, the controller 22 determines that it is necessary to acquire the latest traffic information in order to cope with the changed condition. If the comparison parameter is smaller than or equal to the threshold, the controller 22 determines that it is not necessary to acquire the latest traffic information.

In accordance with an instruction issued from the controller 22, the display controller 23 generates a display image to be displayed on the display unit 18. For example, the display controller 23 reads map data, road data, and the like from the storage unit 17 in accordance with an instruction issued from the controller 22, generates a navigation map as a display image on which an optimal route obtained by the controller 22 is shown and displays the generated display image on the display unit 18.

The display unit 18 displays a display image generated by the display controller 23. The display unit 18 is, for example, a liquid crystal display. The display unit 18 is disposed in a place easily seen by a user, for example, in the vehicle. In addition, the display panel of the display unit 18 may be a touch panel.

The comparison parameter calculated by the controller 22 is described next. The controller 22 calculates the comparison result of a comparison between the previous traffic condition of a route to a destination based on traffic information provided previously and the current traffic condition of the route to the destination. The comparison result can also be a comparison between the previous traveling condition of the vehicle traveling along the route to the destination based on traffic information provided previously and the current traveling condition of the vehicle traveling along the route to the destination.

The comparison result of a comparison between the previous traffic condition and the current traffic condition can be, for example, a result of comparing the degrees of traffic congestion around the vehicle, on a route to the destination, around the route to the destination, or the like, between the previous condition and the current condition.

Around the vehicle, on the route to the destination, around the route to the destination, or the like, the controller 22 counts the number of nodes or links at which traffic information has changed over a predetermined period of time, and calculates the ratio of the number of nodes or links at which traffic information has changed to the total number of nodes or links. The value obtained as described above represents a time shift of the degree of traffic congestion, that is, a temporal change of the degree of congestion. Thus, the obtained value can be used as a comparison parameter.

Figure 2A:
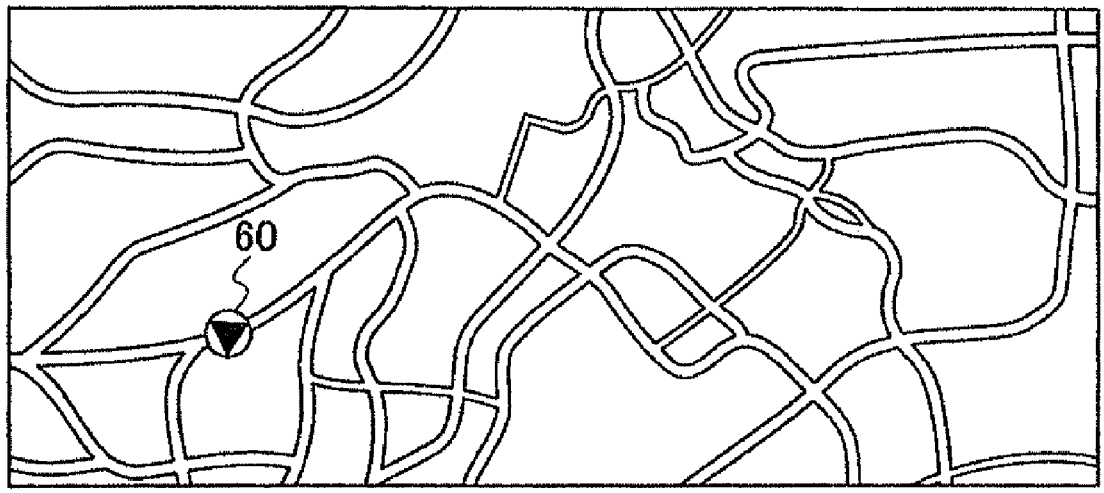
FIGS. 2A and 2B show a temporal change in the degree of traffic congestion used as an example of a comparison parameter.
Figure 2B:
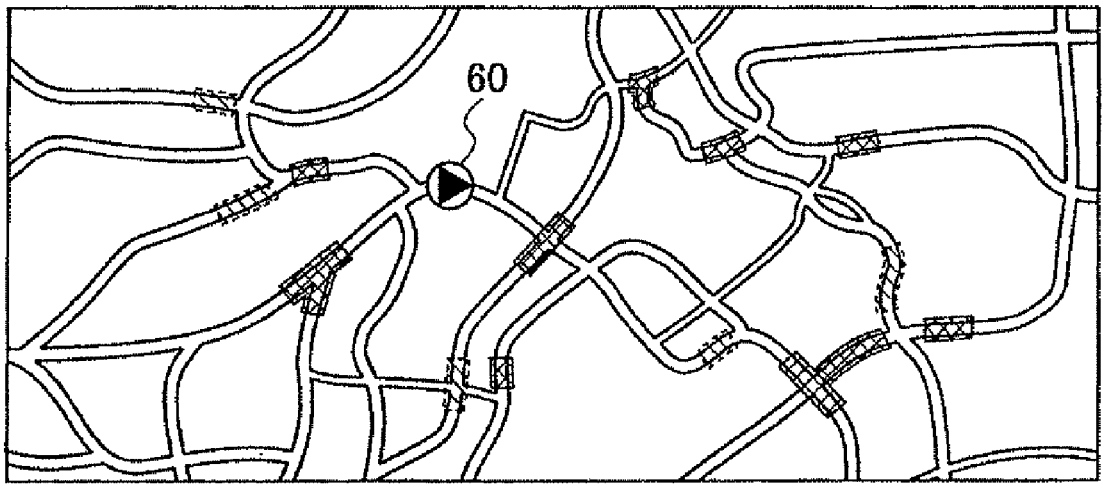

For example, around the current position of a vehicle 60 shown in FIG. 2A, all the nodes or links are in a smooth state (100%), and none of the nodes or links are in a crowded state (0%) or a congested state (0%). However, over a predetermined period of time, a state of the area shown in FIG. 2A has changed as shown in FIG. 2B. That is, as shown in FIG. 2B, the number of nodes or links in the smooth state is reduced to 70%, the number of nodes or links in the crowded state is increased to 10%, and the number of nodes or links in the congested state is increased to 20%. That is, a 30% change has occurred in traffic information over the predetermined period of time.

For example, a threshold used for a threshold-based determination of this first comparison parameter is set to 20%. Since the value 30%, which is obtained in the example shown in FIGS. 2A and 2B, is larger than the threshold, the controller 22 determines that a large change has occurred in a traffic condition. Thus, the controller 22 accesses the center device 30 via the communication unit 10 to acquire traffic information.

The controller 22 may obtain the position of a congestion-prone area in advance in accordance with traffic information provided from the center device 30. In this case, the controller 22 may count the number of nodes or links at which traffic information has changed in the congestion-prone area from among areas around the vehicle, on the route to the destination, around the route to the destination, and the like, and may calculate a temporal change in the degree of traffic congestion in the congestion-prone area. Accordingly, the calculated temporal change may be used as the first comparison parameter.

As described above, since a change in the degree of traffic congestion only in the congestion-prone area is observed, an arithmetic processing load of the controller 22 can be reduced. In addition, the latest traffic information that reliably follows the change in the traffic condition can be acquired.

In addition, around the vehicle, on the route to the destination, around the route to the destination, and the likes the controller 22 may count the number of pieces of information from among congestion information (a congested state, a crowded state, or a smooth state), link traveling time information, link speed information, and the like, that has changed over the predetermined period of time. In this case, the obtained value may be used as the first comparison parameter.

The previous traffic condition, such as the previous degree of traffic congestion described above, can be acquired in accordance with traffic information provided from the center device 30 or the VICS Center 50 in previous processing. In addition, the current traffic condition, such as the current degree of traffic congestion described above, can be acquired in accordance with traffic information provided from the VICS Center 50.

Thus, a first comparison parameter is the result of a comparison between the previous traffic condition and the current traffic condition, indicating a change tendency of traffic information obtained by directly comparing the previous traffic information with the current traffic information.

Another comparison result of a comparison between the previous traveling condition of the vehicle and the current traveling condition of the vehicle can be, for example, a result of a comparison of expected arrival time at which the vehicle is expected to arrive at the destination between the previous traveling condition of the vehicle and the current traveling condition of the vehicle, or a comparison result of a comparison of an expected time required to travel from the position where the vehicle is located to the destination between the previous traveling condition of the vehicle and the current traveling condition of the vehicle is available.

For example, the controller 22 calculates the previously-expected arrival time at which the vehicle was expected to arrive at the destination in accordance with traffic information that was provided from the center device 30 in previous processing or was provided from the VICS Center 50. The controller 22 then calculates the current expected arrival time at which the vehicle is expected to arrive at the destination in accordance with traffic information provided from the VICS Center 50. Then, the controller 22 calculates a difference between the previous expected arrival time and the current expected arrival time, and uses the calculated difference as a second comparison parameter. Similarly, the controller 22 calculates a difference between the previous expected time required to reach the destination and the current expected time required to reach the destination and uses the calculated difference as a second comparison parameter. Accordingly, the controller 22 determines the current traveling condition of the vehicle traveling along the route to the destination in accordance with traffic information provided from the VICS Center 50.

Thus, the second comparison parameter is a result of the comparison between a previous traveling condition of the vehicle and the current traveling condition of the vehicle and represents a change tendency of traffic information obtained by directly comparing the previous traffic information with the current traffic information.

In addition, the controller 22 can calculate the second comparison parameter by determining the current traveling condition of the vehicle traveling along the route to the destination in accordance with the current position of the vehicle calculated by the current position calculator 21.

More specifically, the controller 22 calculates an expected position at which the vehicle was expected to arrive in accordance with the previous expected arrival time and the previous expected time required to reach the destination, which times are both calculated in accordance with traffic information provided previously from the center device 30 or traffic information provided from the VICS Center 50. Then, the controller 22 calculates a difference between the expected position and the current position of the vehicle calculated by the current position calculator 21 and uses the calculated difference as a second comparison parameter. For example, when a threshold is set to fifteen minutes, if the previous expected arrival time is 11:05 and the current expected arrival time is 11:25, a difference of twenty minutes is calculated. Since the difference (that is, twenty minutes) is larger than the threshold (that is, fifteen minutes), the controller 22 determines that a large change has occurred in the traffic condition. Thus, the controller 22 accesses the center device 30 via the communication unit 10 to acquire the latest traffic information.

As described above, the second comparison parameter is a result of the comparison between the previous traveling condition of the vehicle and the current traveling condition of the vehicle and may represent a tendency of the vehicle, instead of a change in traffic information.

In addition, the controller 22 may calculate the difference of expected arrival time at which the vehicle is expected to arrive at a midway point, such as a guidance point, a pass-through point, or a congestion-prone area, which is located between the current position of the vehicle and the destination, between the previous traveling condition of the vehicle and the current traveling condition of the vehicle. The controller 22 may alternately calculate a difference of an expected time required to reach the midway point between the previous traveling condition of the vehicle and the current traveling condition of the vehicle. In these cases, the calculated difference may be used as the second comparison parameter.

Figure 3:
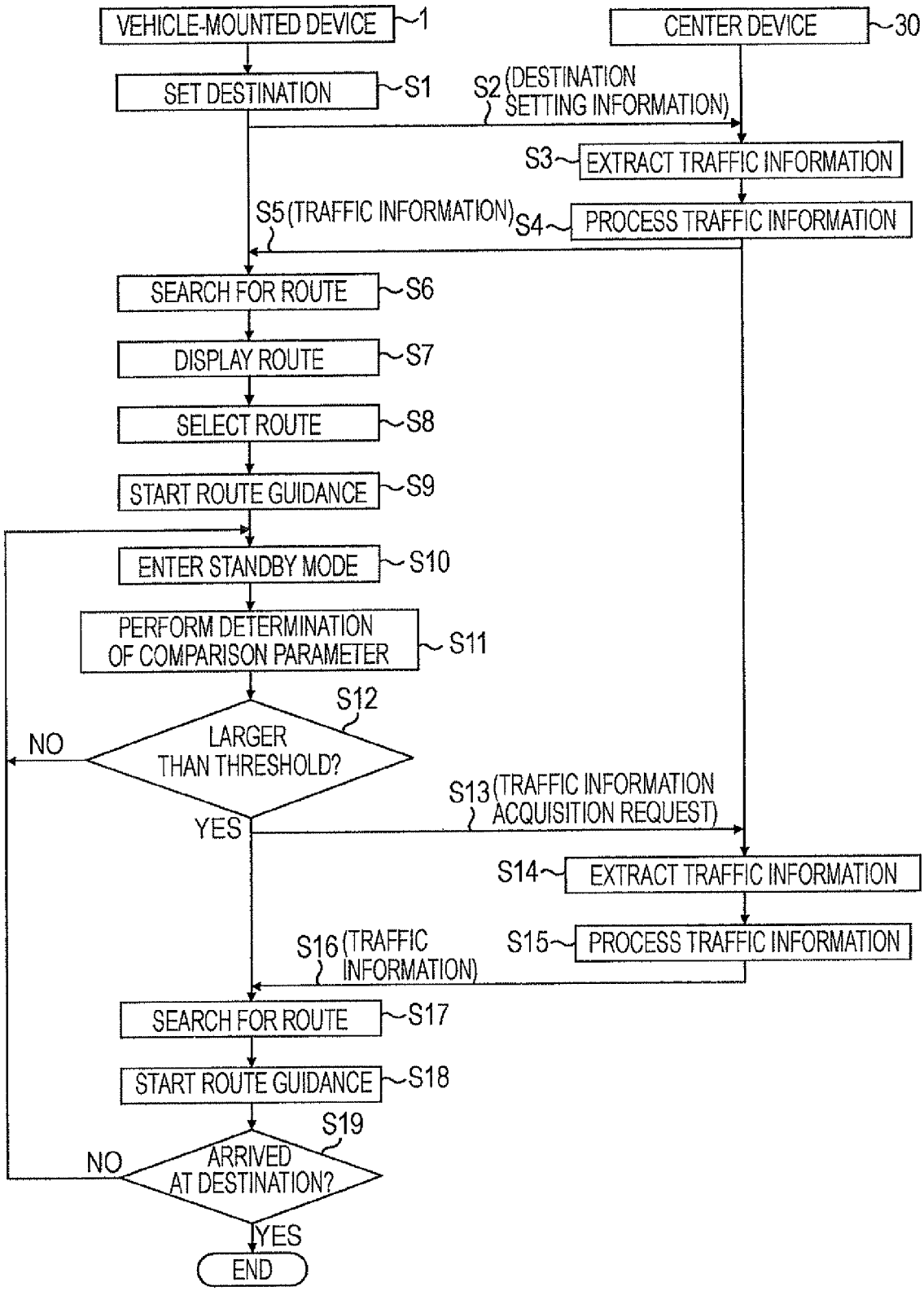
FIG. 3 is a flowchart of a process performed by the traffic-information provision system according to the first embodiment.

A process performed by the traffic-information provision system is described next with reference to a flowchart shown in FIG. 3. Before performing the processing of step S1 of the flowchart shown in FIG. 3, the center device 30 authenticates that the vehicle-mounted device 1 is permitted to use a service provided from the traffic-information provision system through advance registration.

In step S1 the controller 22 of the vehicle-mounted device 1 sets a destination entered by a user via the input unit 16. The user may set a pass-through point as well as the destination. A case where only a destination is set is described below as an example.

In step S2 the controller 22 transmits destination setting information indicating the destination set in step S1 to the center device 30. The destination setting information transmitted to the center device 30 includes current position information indicating the current position of the vehicle calculated by the current position calculator 21. If an operator performs processing in the center device 30, the processing of steps S1 and S2 is performed through conversations between the user and the operator.

In step S3 the center device 30 extracts traffic information in a corresponding section (area) in accordance with the received destination setting information.

In step S4 the center device 30 processes the extracted traffic information that is to be provided to the vehicle-mounted device 1.

In step S5 the center device 30 transmits the processed traffic information to the vehicle-mounted device 1, and in step S6 the controller 22 searches for a route from the current position of the vehicle calculated by the current position calculator 21 to the set destination in accordance with the traffic information received from the center device 30.

In step S7 the controller 22 controls the display controller 23 to display a search result on the display unit 18.

In step S8, the controller 22 sets a route selected by the user via the input unit 16 as an optimal route for guidance. Next, in step S9, the controller 22 starts route guidance based on the set route.

In step S10 the controller 22 enters a standby mode until threshold-based determination of a comparison parameter performed in processing of step S11 and the subsequent processing starts. The threshold-based determination of a comparison parameter is performed, for example, every time a predetermined time has passed (for example, every ten minutes), every time the vehicle has traveled a predetermined distance (for example, every 5 km or miles), or every time the vehicle has arrived at a predetermined position (for example, every intersection).

When the predetermined time has passed, when the vehicle has traveled the predetermined distance and/or when the vehicle has arrived at the predetermined position, the controller 22 calculates a comparison parameter in step S11.

In step S12 the controller 22 performs a threshold-based determination of the comparison parameter calculated in step S11. For example, on the assumption that traffic information cannot be acquired from the VICS Center 50, the controller 22 performs threshold-based determination of one of the above-mentioned comparison parameters. Thus, the controller 22 flexibly performs a threshold-based determination of a comparison parameter according to circumstances. If threshold-based determination of a plurality of comparison parameters is available, the controller 22 determines a comparison parameter to be adopted in accordance with a priority that can be pre-determined by the user of based on certain criteria, such as minimizing distance, minimizing time, etc. The controller 22 then performs the threshold-based determination of the determined comparison parameter.

If the controller 22 determines in step S12 that the comparison parameter is larger than a threshold, the process proceeds to step S13. If the controller 22 determines in step S12 that the comparison parameter is smaller than or equal to the threshold, the process returns to step S10 to stay in the standby mode.

In step S13, the controller 22 accesses the center device 30 via the communication unit 10 and transmits a traffic-information acquisition request to request new traffic information. The controller 22 adds current vehicle position information to the traffic-information acquisition request.

In step S14 the center device 30 extracts traffic information on a corresponding section (area) in accordance with the current vehicle position information included in the traffic-information acquisition request sent from the vehicle-mounted device 1 and the destination setting information sent in step S2.

In step S15 the center device 30 processes the extracted traffic information so as to be provided to the vehicle-mounted device 1, and the center device 30 transmits the processed traffic information to the vehicle-mounted device 1 in step S16.

In step S17 the controller 22 searches for a route from the current position of the vehicle calculated by the current position calculator 21 to the set destination in accordance with the new traffic information received from the center device 30, and, in step S18, the controller 22 controls the display controller 23 to display a new search result on the display unit 18 and starts route guidance.

In step S19 the controller 22 determines whether or not the vehicle has arrived at or around the destination set in step S1. If the controller 22 determines in step S19 that the vehicle has not arrived at or around the destination, the process returns to step S10 (standby mode). If the controller 22 determines in step S19 that the vehicle has arrived at or around the destination, the route guidance is terminated, As described above, in the traffic-information provision system according to the first embodiment of the invention, the controller 22 of the vehicle-mounted device 1 calculates at least a first comparison parameter, which is a result of a comparison between the previous traffic condition of a route to a destination and the current traffic condition of the route to the destination and performs a threshold-based determination of the first comparison parameter. If the first comparison parameter is larger than a threshold, the controller 22 determines that a large change has occurred in a traffic condition. Thus, in order to cope with the changed condition, the controller 22 performs control such that the latest traffic information is acquired from the center device 30.

Accordingly, only when the amount of change in a traffic condition is larger than a predetermined threshold does the vehicle-mounted device 1 access the center device 30 to acquire traffic information. Thus, a communication fee and the amount of data communication can be satisfactorily reduced.

In addition, the controller 22 of the vehicle-mounted device 1 calculates the first comparison parameter by determining the current traffic condition of the route to the destination in accordance with traffic information provided from the VICS Center 50. Since the controller 22 utilizes the VICS Center 50, which is highly established as an existing infrastructure and is used easily in calculation of the first comparison parameter, cost can be significantly reduced.

In addition, since the controller 22 of the vehicle-mounted device 1 calculates the first comparison parameter by using the degree of traffic congestion as the traffic condition, a scene at which it is highly necessary to acquire traffic information can be reliably identified. Thus, route guidance with high accuracy can be provided using the acquired traffic information.

In addition, in the traffic-information provision system according to the first embodiment of the invention, the controller 22 of the vehicle-mounted device 1 can calculate a second comparison parameter, which is a result of a comparison between the previous traveling condition of the vehicle traveling along the route to the destination and the current traveling condition of the vehicle traveling along the route to the destination, and a perform threshold-based determination of the second comparison parameter. If the second comparison parameter is larger than a threshold, the controller 22 determines that a large change has occurred in a traveling condition of the vehicle. Thus, in order to cope with the changed condition, the controller 22 performs control such that the latest traffic information is acquired from the center device 30.

Accordingly, only when the amount of change in a traveling condition of the vehicle is larger than a predetermined threshold does the vehicle-mounted device 1 access the center device 30 to acquire traffic information. Thus, a communication fee and the amount of data communication can be satisfactorily reduced.

In addition, the controller 22 of the vehicle-mounted device 1 calculates the second comparison parameter by determining the current traveling condition of the vehicle traveling along the route to the destination in accordance with traffic information provided from the VICS Center 50. The controller 22 determines the current traveling condition of the vehicle traveling along the route to the destination in accordance with the current position of the vehicle calculated by the current position calculator 21. Thus, when traffic information cannot be acquired from the VICS Center 50 such as when, for example, a communication failure occurs or the vehicle is traveling on a road other than roads supported by the VICS, if the current position of the vehicle can be calculated, the controller 22 is capable of calculating the second comparison parameter. Thus, if the amount of change in a traveling condition of the vehicle is larger than a predetermined threshold, the vehicle-mounted device 1 is capable of reliably acquiring traffic information by accessing the center device 30.

In addition, the vehicle-mounted device 1 can use a cellular phone for data communication with the center device 30. Since a portable telephone line is prevented from being automatically occupied at a predetermined time interval, a situation in which a conversation function of the cellular phone is unavailable can be avoided.

In addition, a complicated user operation that would be required when traffic information is acquired at a designated position for calculating a point at which it is desired to complete acquisition of the traffic information by reverse calculation of a communication time for acquiring the traffic information and a processing time for the acquired traffic information can be avoided.

A traffic-information provision system according to a second embodiment of the invention is described next with reference to FIG. 4. The traffic-information provision system according to the second embodiment is different from first embodiment shown in FIG. 1 in that, instead of the vehicle-mounted device 1, the center device 30 calculates a comparison parameter and performs threshold-based determination of the comparison parameter. Since the traffic-information provision system according to the second embodiment shown in FIG. 4 has a similar configuration to the first embodiment shown in FIG. 1, descriptions of the same component parts as in FIG. 1 are omitted in an appropriate manner.

Figure 4:
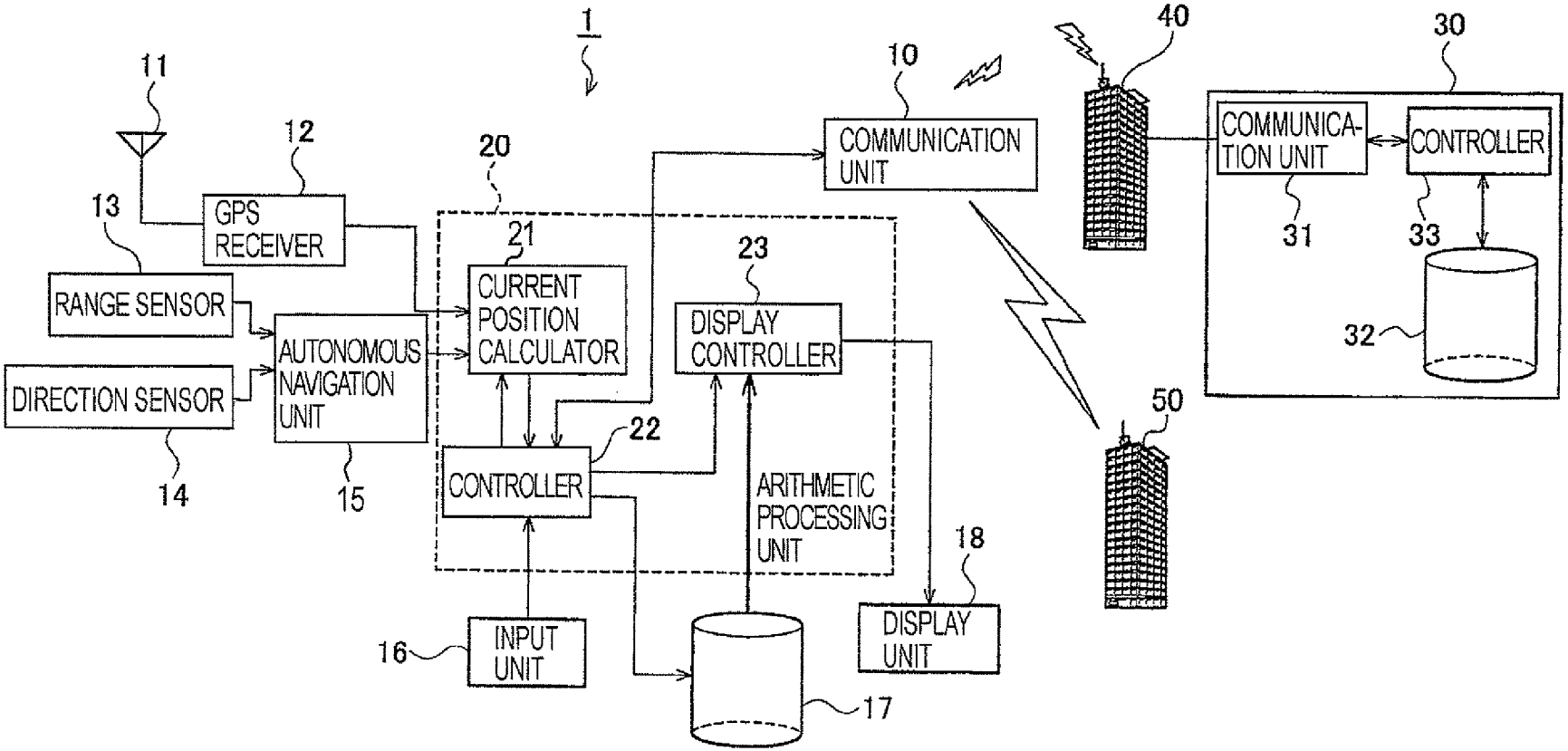
FIG. 4 shows a configuration of a traffic-information provision system according to a second embodiment of the invention.

Referring to FIG. 4, the center device 30 includes a communication unit 31, a storage unit 32 and a controller 33. The communication unit 31 is a communication interface used for data communication with the vehicle-mounted device 1 under the communication control of the communication center apparatus 40.

The storage unit 32 stores various software applications to be executed by the center device 30 and traffic information to be provided to the vehicle-mounted device 1. The traffic information is collected by a certain procedure (for example, a probe survey, a questionnaire survey or provision from the VICS Center 50) in accordance with an existing statistical procedure, forecasting calculation, or the like as discussed previously.

In addition, identification information for identifying an authenticated user registered in advance for the corresponding traffic information system is stored in the storage unit 32. As identification information for identifying an authenticated user, for example, an apparatus ID allocated for each vehicle-mounted device can be used. The storage unit 32 includes a control and storage region in which information on a registered user is stored for each piece of identification information. For example, a fixed high-capacity HD may be used as the storage unit 32.

The controller 33 generally controls the center device 30 and is a microprocessor or the like as discussed previously with respect to the arithmetic processing unit 20. The controller 33 performs authentication processing for a user who requests acquisition of traffic information using the traffic-information provision system via the vehicle-mounted device 1, provision of traffic information in an initial stage of route guidance, calculation of a comparison parameter during the provision of the route guidance, threshold-based determination of the comparison parameter, provision of new traffic information corresponding to a result of the threshold-based determination, and the like.

In the traffic-information provision system according to the second embodiment of the invention, under the control of the controller 33 of the center device 30, calculation of a comparison parameter during the execution of route guidance, threshold-based determination of the comparison parameter and provision of new traffic information corresponding to a result of the threshold-based determination are performed. Thus, the traffic-information provision system according to the second embodiment has a simpler configuration with the same functions as in the controller 22 of the vehicle-mounted device 1 in the traffic-information provision system according to the first embodiment.

A comparison parameter calculated by the controller 33 is described next. The controller 33 calculates a result of a comparison between the previous traffic condition of a route to a destination based on traffic information provided previously to the vehicle-mounted device 1 and the current traffic condition of the route to the destination and/or a result of a comparison between the previous traveling condition of the vehicle traveling along the route to the destination based on traffic information provided previously to the vehicle-mounted device 1 and the current traveling condition of the vehicle traveling along the route to the destination.

Although the controller 22 of the vehicle-mounted device 1 calculates a comparison parameter in the traffic-information provision system according to the first embodiment, the controller 33 of the center device 30 calculates a comparison parameter in the traffic-information provision system according to the second embodiment.

The controller 33 is capable of acquiring the previous traffic condition and the previous traveling condition of the vehicle in accordance with, for example, traffic information transmitted to the vehicle-mounted device 1 in previous processing. In addition, the controller 33 is capable of acquiring the current traffic condition and the current traveling condition of the vehicle in accordance with, for example, traffic information provided from the VICS Center 50 or traffic information that is subjected to statistic processing or prediction and that is stored in the storage unit 32.

In a similar manner to the procedure adopted by the controller 22, for example, the controller 33 can calculate a first comparison parameter, which is a result of a comparison between the previous traffic condition and the current traffic condition, by obtaining a temporal change in the degree of traffic congestion indicated as traffic information. The controller 33 can also calculate a second comparison parameter, which is a result of a comparison between the previous traveling condition of the vehicle and the current traveling condition of the vehicle, by obtaining a temporal change in expected arrival time or an expected time required to reach a destination based on traffic information.

Figure 5:
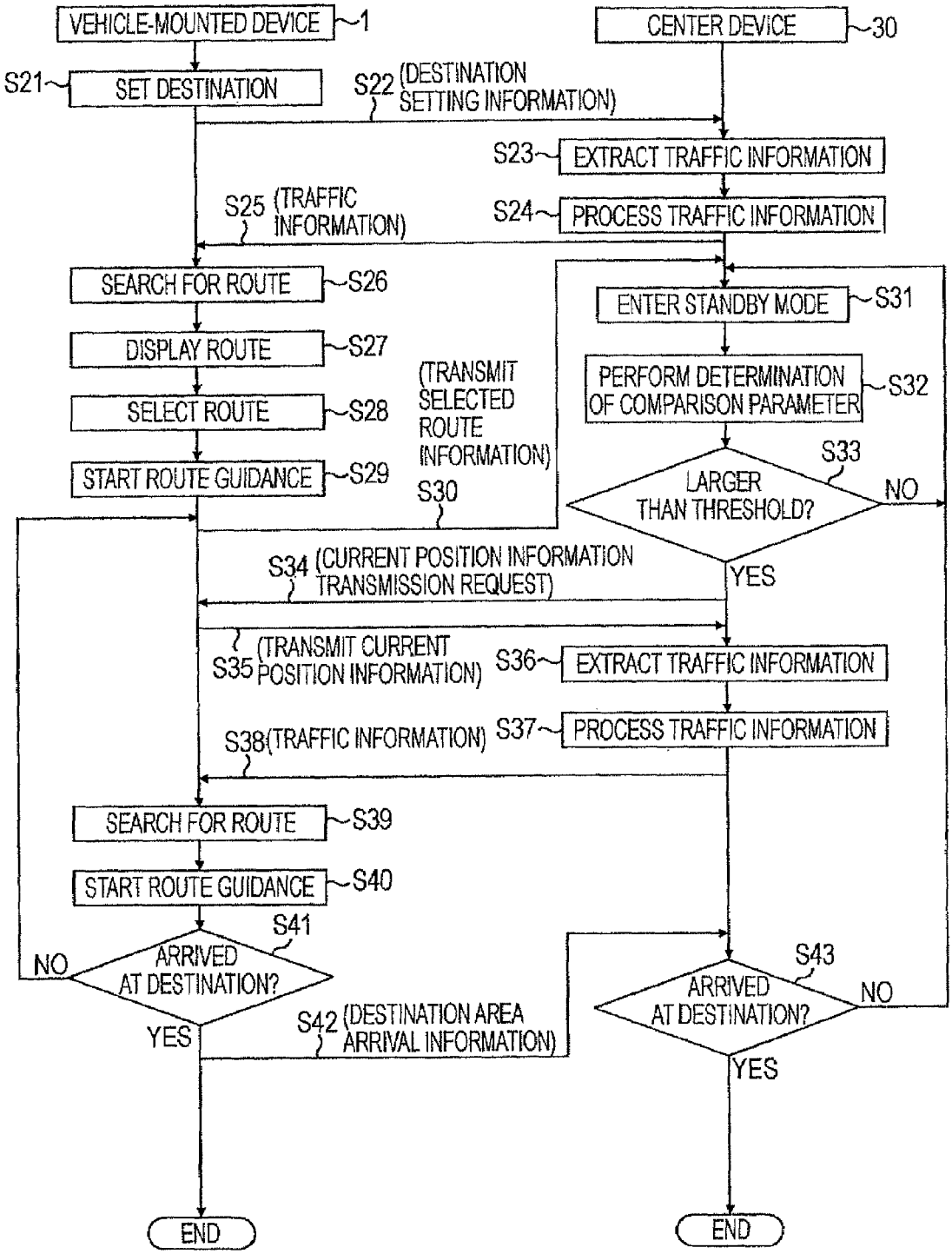
FIG. 5 is a flowchart of a process performed by the traffic-information provision system according to the second embodiment.

A process performed by the traffic-information provision system according to the second embodiment is described next with reference to a flowchart shown in FIG. 5. Before processing starts at step S21 of the flowchart shown in FIG. 5, the center device 30 authenticates that the vehicle-mounted device 1 is permitted to use a service provided from the traffic-information provision system by advance registration.

In step S21 the controller 22 of the vehicle-mounted device 1 sets a destination entered by a user via the input unit 16. The user may set a pass-through point as well as the destination. A case where only a destination is set is described below as an example.

In step S22 the controller 22 transmits to the center device 30 destination setting information indicating the destination set in step S21. The destination setting information transmitted to the center device 30 includes current position information indicating the current position of the vehicle calculated by the current position calculator 21. The controller 33 of the center device 30 stores the received current position information and destination setting information in the control and storage region of the storage unit 32 in association with identification information for identifying the user and controls the stored current position information, destination setting information and identification information.

If an operator performs processing in the center device 30, the processing of steps S21 and S22 is performed through conversations between the user and the operator.

In step S23 the controller 33 of the center device 30 extracts traffic information for a corresponding section (area) in accordance with the destination setting information. The controller 33 stores extraction time information indicating the extraction time at which the traffic information is extracted in the control and storage region of the storage unit 32 in association with the identification information for identifying the user. The controller 33 also controls the stored extraction time information and identification information.

In step S24 the controller 33 processes the extracted traffic information so as to be provided to the vehicle-mounted device 1 and transmits the processed traffic information to the vehicle-mounted device 1 in step S25.

In step S26 the controller 22 of the vehicle-mounted device 1 searches for a route from the current position of the vehicle calculated by the current position calculator 21 to the set destination in accordance with the traffic information received from the center device 30. Then, in step S27, the controller 22 controls the display controller 23 to display a search result on the display unit 18.

In step S28 the controller 22 sets a route selected by the user via the input unit 16 as an optimal route for guidance, and the controller 22 starts route guidance based on the set route in step S29.

In step S30 the controller 22 transmits route information on the set route to the center device 30 via the communication unit 10. The controller 33 of the center device 30 stores the received route information in the control and storage region of the storage unit 32 in association with the identification information and controls the stored route information and identification information.

In step S31 the controller 33 of the center device 30 enters a standby mode until threshold-based determination of a comparison parameter performed in processing of step S32 and the subsequent processing starts. The threshold-based determination of a comparison parameter is performed, for example, every time a predetermined time has passed, every time the vehicle has traveled a predetermined distance or every time the vehicle has arrived at a predetermined position as discussed with respect to the first embodiment.

When the predetermined time has passed, when the vehicle has traveled the predetermined distance, or when the vehicle has arrived at the predetermined position, the controller 33 calculates a comparison parameter in step S32.

In step S33 the controller 33 performs a threshold-based determination of the comparison parameter calculated in step S32. For example, on the assumption that traffic information cannot be acquired from the VICS Center 50, the controller 33 performs a threshold-based determination of one of the above-mentioned comparison parameters. Thus, the controller 33 flexibly performs a threshold-based determination of a comparison parameter according to circumstances. If a threshold-based determination of a plurality of comparison parameters is available, the controller 33 determines a comparison parameter to be adopted in accordance with a predetermined priority and performs the threshold-based determination of the determined comparison parameter.

If the controller 33 determines in step S33 that the comparison parameter is larger than a threshold, the process proceeds to step S34. If the controller 33 determines in step S33 that the comparison parameter is smaller than or equal to the threshold, the process returns to step S31.

In step S34 the controller 33 accesses the vehicle-mounted device 1 via the communication unit 31 to transmit a request for requesting the current position of the vehicle. Then, in step S35 the controller 22 of the vehicle-mounted device 1 transmits to the center device 30 the current position of the vehicle calculated by the current position calculator 21 to be used as current position information.

In step S36 the controller 33 of the center device 30 extracts traffic information for a corresponding section (area) in accordance with the current position information received from the vehicle-mounted device 1 and the destination setting information stored in the storage unit 32.

In step S37 the controller 33 processes the extracted traffic information so as to be provided to the vehicle-mounted device 1, and the center device 30 transmits the processed traffic information to the vehicle-mounted device 1 in step S38.

In step S39 the controller 22 of the vehicle-mounted device 1 searches for a route from the current position of the vehicle calculated by the current position calculator 21 to the set destination in accordance with the new traffic information received from the center device 30. When receiving the traffic information, the controller 22 transmits to the center device 30 an acknowledgement signal to report that the traffic information has been received.

In step S40 the controller 22 controls the display controller 23 to display a new search result on the display unit 18 and starts route guidance.

In step 841 the controller 22 determines whether or not the vehicle has arrived at or around the destination set in step S21. If the controller 22 determines in step S41 that the vehicle has not arrived at or around the destination, the process returns to step S30. If the controller 22 determines in step S41 that the vehicle has arrived at or around the destination, the process proceeds to step 842.

When the vehicle has arrived at or around the destination, the controller 22 transmits destination-area arrival information indicating that the vehicle has arrived at or around the destination to the center device 30 in step S42. After the controller 22 transmits the destination-area arrival information to the center device 30, the process is terminated.

In step S43 the controller 33 of the center device 30 determines whether or not the controller 33 has received destination-area arrival information from the vehicle-mounted device 1. If the controller 33 determines that the controller 33 has not received destination-area arrival information from the vehicle-mounted device 1, the process returns to step S31. If the controller 33 determines that the controller 33 has received destination-area arrival information from the vehicle-mounted device 1, the process is terminated.

If the controller 33 has not received destination-area arrival information, the controller 33 attempts to transmit traffic information to the vehicle-mounted device 1 several times, taking into consideration the possibility of a failure in transmission or reception of destination-area arrival information. If the controller 33 has not received an acknowledgement signal indicating that traffic information or destination-area arrival information has been received in spite of transmission of traffic information, the controller 33 determines that the vehicle-mounted device 1 has been shut down. Thus, the controller 33 terminates processing with the vehicle-mounted device 1.

As described above, in the traffic-information provision system according to the second embodiment, the controller 33 of the center device 30 calculates a first comparison parameter, which is a result of a comparison between the previous traffic condition of a route to a destination and the current traffic condition of the route to the destination, and performs threshold-based determination of the first comparison parameter. If the first comparison parameter is larger than a threshold, the controller 33 determines that a large change has occurred in a traffic condition. Thus, in order to cope with the changed condition, the controller 33 performs control such that the latest traffic information is provided to the vehicle-mounted device 1.

Since access from the vehicle-mounted device 1 to the center device 30 is permitted such that traffic information is provided only when the amount of change in a traffic condition is larger than a predetermined threshold, a communication fee and the amount of data communication can be satisfactorily reduced.

In addition, since the first comparison parameter can be calculated by using the degree of traffic congestion as the traffic condition, a scene at which it is highly necessary to provide traffic information can be reliably identified. Thus, the vehicle-mounted device 1 is capable of providing route guidance with high accuracy using traffic information provided from the center device 30.

In addition, in the second embodiment of the invention, the controller 33 of the center device 30 can also calculate a second comparison parameter, which is a result of a comparison between the previous traveling condition of the vehicle traveling along the route to the destination and the current traveling condition of the vehicle traveling along the route to the destination. The controller 33 can also perform a threshold-based determination of the second comparison parameter. If the second comparison parameter is larger than a threshold, the controller 33 determines that a large change has occurred in a traveling condition of the vehicle. Thus, in order to cope with the changed condition, the controller 33 performs control such that the latest traffic information is provided to the vehicle-mounted device 1.

Accordingly, since access from the vehicle-mounted device 1 to the center device 30 is permitted such that traffic information is provided only when the amount of change in a traveling condition of the vehicle is larger than a predetermined threshold, a communication fee and the amount of data communication can be satisfactorily reduced.

In addition, the processing load of the vehicle-mounted device 1 can be reduced over that in the first embodiment since the center device 30 performs calculation of a comparison parameter and threshold-based determination of the comparison parameter.

Arithmetic processing time can also be reduced since the center device 30, which has a high information processing capability, performs calculation of a comparison parameter and threshold-determination of the comparison parameter. Thus, new traffic information can be rapidly provided to the vehicle-mounted device 1. Therefore, the vehicle- mounted device 1 is capable of providing highly convenient route guidance that follows a traffic condition and a vehicle traveling condition that change with time.

A case where the vehicle-mounted device 1 uses a cellular phone for data communication with the center device 30 is possible. Since a portable telephone line is prevented from being automatically occupied at a predetermined time interval, a situation in which a conversation function of the cellular phone is unavailable can be avoided.

In addition, a complicated user operation that would be required when traffic information is acquired at a designated position for calculating a point at which it is desired to complete acquisition of the traffic information by reverse calculation of a communication time for acquiring the traffic information and a processing time for the acquired traffic information can be avoided.

Each of the foregoing embodiments is merely an example of the invention. Thus, the invention is not limited to any of the foregoing embodiments. Various changes and modifications can be made to the invention depending on design and the like without departing from a technical idea of an embodiment of the invention. As just one example, although the comparison of only one comparison parameter is shown prior to updating the traffic information to search or a new route, etc., two such queries can be made in sequence. In this case, the update is not performed unless both the first comparison parameter and the second comparison parameter are above respective thresholds.

Accordingly, the above-described embodiments have been described in order to allow easy understanding of the invention and do not limit the invention. On the contrary, the invention is intended to cover various modifications and equivalent arrangements included within the scope of the appended claims, which scope is to be accorded the broadest interpretation so as to encompass all such modifications and equivalent structure as is permitted under the law.

What is claimed is:

1. A vehicle-mounted device that acquires traffic information for a vehicle, comprising:

a traffic-information acquisition unit configured to automatically acquire traffic information from a first source of traffic information, said first source configured to provide traffic information via wireless communication; and a controller configured to:

responsive to a request from a driver to set a destination for the vehicle, control the traffic-information acquisition unit to acquire traffic information from an external second source of traffic information, the second source having at least certain traffic information not available from the first source and configured to provide traffic information to the traffic-information acquisition unit;

calculate a route to the destination using the traffic information from the first source and the second source;

during guidance along the route, control the traffic-information acquisition unit to acquire current traffic information from the second source only if a value of at least one of a change between a current traffic condition along the route and a previous traffic condition along the route or between a previous traveling condition of the vehicle and a current traveling condition of the vehicle is larger than a predetermined threshold, the previous traffic condition based on previously-provided traffic information; and recalculate the route to the destination using at least one of the current traffic information, the current traveling condition of the vehicle or the current traffic condition along the route if the traffic-information acquisition unit acquires the current traffic information.

2. The device according to claim 1, further comprising:

a comparator configured to determine, at predetermined intervals, the value of the change between the current traffic condition along the route and the previous traffic condition along the route; wherein the comparator is part of the controller; and wherein the controller, during guidance along the route, controls the traffic-information acquisition unit to acquire the current traffic information from the second source only if the value of the change between the current traffic condition along the route and the previous traffic condition along the route is larger than a first predetermined threshold.

3. The device according to claim 1 wherein the current traffic condition and the previous traffic condition include a degree of traffic congestion as a traffic condition.

4. The device according to claim 1, further comprising:

a comparator configured to determine, at predetermined intervals, the value of the change between the previous traveling condition of the vehicle and the current traveling condition of the vehicle; and wherein the controller, during guidance along the route controls the traffic-information acquisition unit to acquire the current traffic information from the second source only if the value of the change between the previous traveling condition of the vehicle and the current traveling condition of the vehicle is larger than a second predetermined threshold; and wherein the comparator is part of the controller.

5. The device according to claim 4, further comprising:

a current-position detector configured to detect a current position of the vehicle; and wherein the current traveling condition is based on traffic information provided from at least one of the first source or the current position detected by the current-position detector.

6. The device according to claim 1 wherein the previous traffic condition is a first degree of traffic congestion at a first period of time, the current traffic condition is a second degree of traffic congestion at a later, second period of time, and the value of the change is a difference between the first degree of traffic congestion and the second change in the degree of traffic congestion.

7. The device according to claim 1 wherein the controller is configured to transmit a current position of the vehicle to the second source in response to a request from the second source generated when the value of the change between the current traffic condition along the route and the previous traffic condition along the route is larger than the predetermined threshold.

8. The device according to claim 7 wherein the current traffic information sent from the second source is based on the current position of the vehicle.

9. The device according to claim 1 wherein the controller is configured to control the traffic-acquisition unit to transmit a request for the current traffic information to the second source only if the value of at least one of the change between the current traffic condition along the route and the previous traffic condition along the route or the previous traveling condition of the vehicle and the current traveling condition of the vehicle is larger than the predetermined threshold.

10. The device according to claim 1 wherein the controller is configured to control the traffic-acquisition unit to transmit a request for the current traffic information to the second source only if the value of each of the change between the current traffic condition along the route and the previous traffic condition along the route is larger than a first predetermined threshold and between the previous traveling condition of the vehicle and the current traveling condition of the vehicle is larger than a second predetermined threshold.

11. The device according to claim 1 wherein the first source is a free source of traffic information and the second source is a fee-based source of traffic information.

12. A traffic-information provision system for providing traffic information to a vehicle-mounted device, the system comprising:

a first source of traffic information configured to automatically provide traffic information to the vehicle-mounted device via wireless communication;

an external second source of traffic information configured to provide traffic information to the vehicle-mounted device via wireless communication, the second source having at least certain traffic information not available from the first source; and a controller of the vehicle-mounted device configured to:

responsive to a request from a driver to set a destination for the vehicle, control the traffic-information acquisition unit to calculate a route to the destination using traffic information from the first source and the second source;

follow the route to the destination based on current traffic information from the first source;

monitor at least one of traffic conditions along the route or traveling conditions of the vehicle while following the route; and control the second source to provide updated current traffic information to the vehicle-mounted device while following the route only when a change occurs between at least one of a current traffic condition and a previous traffic condition along the route or a current traveling condition of the vehicle and a previous traveling condition of the vehicle that is larger than a predetermined threshold, the previous traffic condition based on previously-provided traffic information used to calculate the route.

13. The system according to claim 12 wherein the controller is configured to control the second source to provide the updated current traffic information to the vehicle-mounted device responsive to a value obtained from a comparator comparing the previous traffic condition and the current traffic condition being larger than the predetermined threshold.

14. The system according to claim 12 wherein the current traffic condition and the previous traffic condition are based on a degree of traffic congestion.

15. The system according to claim 12 wherein the controller is configured to:

control the second source to provide the updated current traffic information to the vehicle-mounted device responsive to a value obtained by a comparison between a previous traveling condition and a current traveling condition of the vehicle including the vehicle-mounted device being larger than the predetermined threshold.

16. A traffic-information acquisition method for use with a vehicle-mounted device of a vehicle, the method comprising:

following a route to a destination using a controller of the vehicle-mounted device based on traffic information automatically retrieved from a first source of traffic information configured to provide traffic information via wireless communication and retrieved from an external second source of information acquired in response to a request of a driver of the vehicle to set the destination of the vehicle, the second source having at least certain traffic information not available from the first source and configured to provide traffic information to the vehicle-mounted device;

monitoring at least one of traffic conditions along the route or traveling conditions of the vehicle while following the route;

determining at predetermined intervals at least one of a change between a current traffic condition and a previous traffic condition along the route or between a current traveling condition and a previous traveling condition of the vehicle, the previous traffic condition based on previously-provided traffic information; and acquiring current traffic information from the second source via wireless communication while following the route only when a value of the change is larger than a predetermined threshold.

17. The method according to claim 16 wherein the previous traffic condition and the current traffic condition are based on a degree of traffic congestion

18. The method according to claim 16, further comprising:

calculating a revised route to the destination using the controller based on the current traffic information from the second source when the value of the change is larger than the predetermined threshold.

19. The method according to claim 18 wherein the previous traffic condition is a first degree of traffic congestion at a first period of time, the current traffic condition is a second degree of traffic congestion at a later, second period of time, and the change is a difference between the first degree of traffic congestion and the second change in the degree of traffic congestion.

20. The method according to claim 18 wherein the previous traffic condition is a first amount of travel time to the destination at a first period of time, the current traffic condition is a second amount of travel time to the destination at a later, second period of time, and the change is a difference between the first amount of travel time and a second amount of travel time.

* * * * *